US005184972A

United States Patent [19]

Tomberlin

[11] Patent Number: 5,184,972

[45] Date of Patent: Feb. 9, 1993

[54] SELECTIVE FREE ROTATION YO-YO

[76] Inventor: Rand K. Tomberlin, 4017 N. Bennington, Apt. 104, Kansas City, Mo. 64117

[21] Appl. No.: 762,929

[22] Filed: Sep. 19, 1991

[51] Int. Cl.[5] ..... A63H 1/30

[52] U.S. Cl. ..... 446/250; 446/249

[58] Field of Search ..... 446/249, 250, 251

[56] References Cited

U.S. PATENT DOCUMENTS 3,139,699 7/1964 Chuy ..... 446/250

3,362,101 1/1968 Grow ..... 446/249

*Primary Examiner*—Mickey Yu

*Attorney, Agent, or Firm*—Kokjer, Kircher, Bowman and Johnson

[57] ABSTRACT

A yo-yo having a pair of rotation bodies spaced from each other by a shaft, with the shaft means having a string connected thereto. Mechanisms are provided between the shaft and the rotation bodies such that: the shaft is fixed with respect to the rotation bodies as the string is unwound and the yo-yo travels downward; the shaft my rotate with respect to the rotation bodies for a selected number of rotations when the string has been completely unwound; and the shaft is fixed with respect to the rotation bodies after completion of the selected number of rotations and may therefore rewind the string to return the yo-yo to the user's hand. This mechanism may take various forms, including gears, locking tines, and tape reels.

20 Claims, 2 Drawing Sheets

SELECTIVE FREE ROTATION YO-YO

BACKGROUND OF THE INVENTION

1. Field of the Invention

The present invention relates in general to amusement devices and toys. In particular, the present invention relates to an improved yo-yo which spins freely, upon unwinding, for a predetermined number of rotations.

2. Description of the Related Art

Yo-yos have been known for many years, and continue to enjoy wide popularity. The general components of a yo-yo are a shaft, a rotation body mounted at each end of the shaft and a string mounted to the shaft such that it may be wound upon, and unwound from, the shaft during play. To improve the enjoyment of using a yo-yo it is common for the user to attempt various "tricks" with the yo-yo. Many of these tricks require that the yo-yo spin at the end of the string without winding the string about the shaft, which is commonly referred to as "sleeping".

Sleeping may be achieved by forming a loop at the end of the string through which the shaft extends. The shaft will thus rotate within this loop during sleeping. However, the friction between the loop and the shaft reduces the amount of time the yo-yo sleeps, and wears the string, causing it to break prematurely.

Various yo-yo designs have been proposed to obviate this problem. U.S. Pat. No. 3,175,326 to Isaacson and U.S. Pat. No. 4,895,547 to Amaral both employ a sleeve which may rotate freely about the shaft, with the string attached to the sleeve. This substantially eliminates the wear on the string during sleeping. However, it may be difficult to cause the string to begin rewinding upon the sleeve to return the yo-yo to the user's hand.

A more sophisticated approach is taken in U.S. Pat. No. 4,332,102 to Caffrey. This patent discloses a sleeve on the shaft as in the previously-noted patents, but Caffrey adds a centrifugal clutch between the rotation body and the sleeve. This allows the sleeve to rotate with respect to the shaft above a certain RPM of the rotation body, but fixes the sleeve against relative rotation below this RPM, allowing the yo-yo to be easily retrieved into the user's hand. While this arrangement allows easier rewinding of the string, it often occurs that the clutch release RPM is reached before the string is fully unwound. This results in the remainder of the string unwinding without adding additional torque to the yo-yo, reducing the possible speed of rotation and the duration of the yo-yo's sleep.

SUMMARY OF THE INVENTION

An object of the present invention is to provide a yo-yo which is easily placed in a free-spinning "sleeping" condition.

Another object of the present invention is to provide a yo-yo which reduces or eliminates the friction and wear between the string and shaft during such sleeping.

A further object of the present invention is to provide a yo-yo having a shaft means which rotates with respect to the rotation bodies only when the yo-yo has reached the end of the string, yet which will cease this relative rotation to allow easy retrieval of the yo-yo.

Another object of the present invention is to provide such a yo-yo in which the shaft means rotates with respect to the rotation bodies only for a certain predetermined number of revolutions.

Yet another object of the present invention is to provide such a yo-yo in which such number of revolutions may be selected by the user.

These and other objects are achieved by a yo-yo having a pair of rotation bodies spaced from each other by shaft means, with the shaft means having a string connected thereto. Means are provided between the shaft means and the rotation bodies such that: the shaft means is fixed with respect to the rotation bodies as the sting is unwound and the yo-yo travels downward; the shaft means may rotate with respect to the rotation bodies for a selected number of rotations when the string has been completely unwound; and the shaft means is fixed with respect to the rotation bodies after completion of the selected number of rotations and may therefore rewind the string to return the yo-yo to the user's hand. This means may take various forms, including gears, locking tines, and tape reels.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
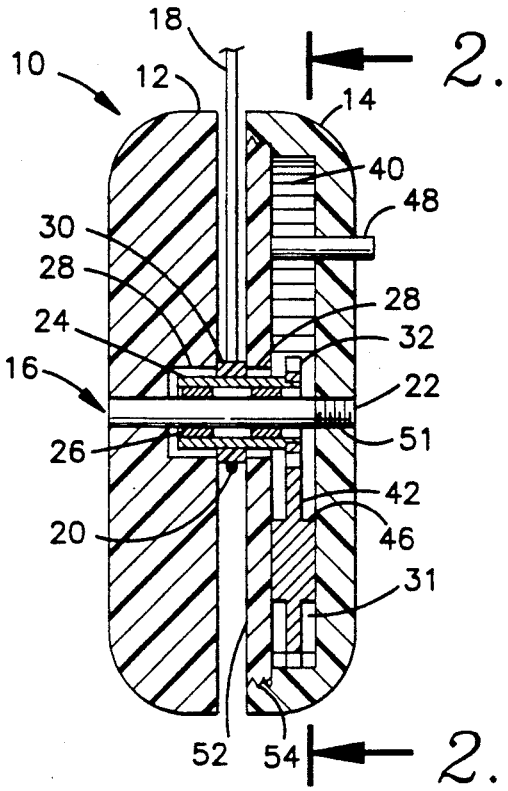
FIG. 1 is a front cross-sectional view of a first embodiment of a yo-yo according to the present invention.
Figure 2:
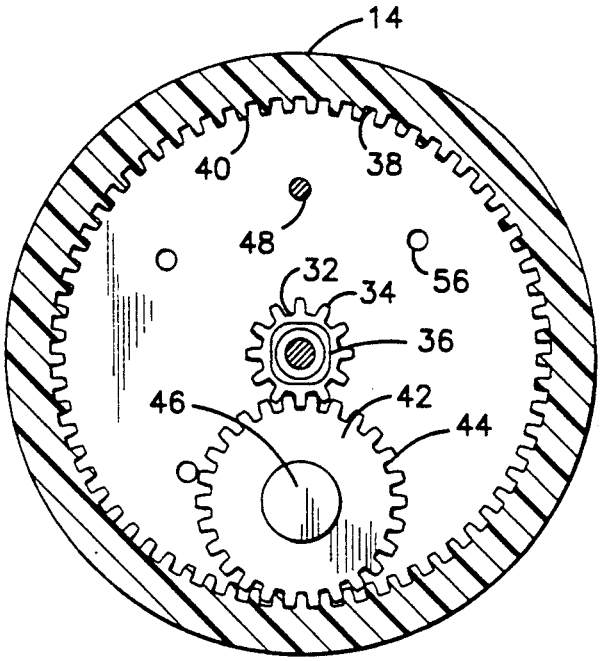
FIG. 2 is a cross-sectional view along line 2—2 of FIG. 1.

With reference to FIGS. 1 and 2, a first embodiment of a yo-yo according to the present invention is generally designated by reference numeral 10. The yo-yo 10 generally includes a first rotation body 12, a second rotation body 14, shaft means 16 extending between the rotation bodies, and a string 18 having a first end 20 connected to the shaft means 16 and a second end (not shown) which may be retained by the user. The first end of the string may be rigidly connected to the shaft means or may be looped therearound to allow the shaft means to rotate with respect to the first end of the string.

The rotation bodies are typically formed of plastic, ceramic or metal, preferably have a circular periphery, as shown in FIG. 2, and are arranged such that their longitudinal axes, and the longitudinal axis of the shaft means, are substantially coincident. The rotation bodies are spaced from each other along the longitudinal axis of the shaft means to allow the string 18 to reach the shaft means for connection thereto, and to allow the majority of the string to be wound upon the shaft means.

The shaft means comprises a central shaft 22 which is fixed as by molding or adhesives, or releasably fixed as by threads, to the rotation bodies, and a sleeve 24 coaxial about the exterior of the shaft and capable of rotation relative to the shaft. The sleeve 24 may rotate directly upon the shaft 22, and in this instance the shaft is preferably formed of a polished metal and the sleeve formed of a low friction plastic, although other materials could be employed. Alternatively, the shaft means may further include bearings 26 between the shaft and the sleeve, with the shaft and sleeve being formed of metal, plastic, ceramic or other materials. In either case, it should be apparent that it is important that the sleeve be allowed to rotate with respect to the shaft with as little friction as is feasible.

The sleeve 24 is elongated for a reason discussed below, and due to this elongation the rotation bodies contain cavities 28 to receive the sleeve, with these cavities being in spaced facing relationship, as shown in FIG. 1. To allow the sleeve to rotate properly the cavities must be spaced from the sleeve. However, this creates a small gap about the periphery of the sleeve which could catch or receive a portion of the string and impair operation of the yo-yo. For this reason a spacer 30 may be fixed to the periphery of the sleeve such that the spacer is mounted between the rotation bodies, and has a height sufficient to block at least the majority of the gap between the sleeve and the cavities. Since the spacer is fixed to the sleeve, the spacer must still be spaced slightly from the rotation bodies to allow proper rotation of the sleeve, but such tolerances are believed to be easier to produce and are less likely to impair yo-yo operation.

The yo-yo 10 also includes means, generally designated by reference numeral 32, for allowing rotation of the shaft means with respect to the rotation bodies (hereinafter rotation means or means for rotation). In particular, in the embodiment of FIGS. 1 and 2, this means takes the form of a planetary gear system located within the second rotation body 14. As will be apparent, the location of this means within the second rotation body is the reason for the sleeve 24 being wider than the distance between the rotation bodies.

As is best shown in FIG. 1, the cavity 28 formed in the second rotation body 14 opens into a chamber 31 within the second rotation body. The end of sleeve 24 which extends into rotation body 14 also extends into chamber 31 and includes a reduced diameter section which forms a shoulder on the sleeve. Mounted upon this shoulder is a sun gear 32 having gear teeth 34 extending about the periphery thereof. While the sun gear is indicated as being mounted upon the sleeve, it could of course be formed with the sleeve as a monolithic unit. Alternatively, the reduced diameter section may have flats 36 therein (or other configurations to restrict rotation between the sleeve and the sun gear) and the sun gear be removably mounted upon the sleeve, for a reason discussed below.

The means for rotation also includes a ring gear 38 defined by a plurality of gear teeth 40 within the rotation body 14 coaxial to the sun gear 32. While the ring gear could be a separate element fixed within body 14, it is preferred that the ring gear be formed integrally with this body. Additionally, the means for rotation includes a planet gear 42 within the body 14 and having a plurality of exterior teeth 44 in meshing engagement with the teeth 34 and 40. As shown in FIG. 1, the planet gear may include protrusions 46 extending laterally outwardly therefrom which make sliding contact with the interior walls of the chamber 31 to maintain the planet gear in the proper orientation. This increases friction somewhat, but the friction produced is less than that which would be produced if the entire planet gear were made laterally thicker.

Finally, the means for rotation includes a blocking pin 48 which extends into the chamber 31 a sufficient amount such that it blocks movement of the planet gear. Blocking pin 48 may be formed as a portion of body 14 or may be a separate element retained in this position by its placement within a hole 50 extending at least into a portion of the body 14 such that the pin may enter chamber 31 a distance sufficient to block the movement of planet gear 42.

The operation of the yo-yo 10 will now be described. In this regard all statements of clockwise and counterclockwise directions are with reference to FIG. 2.

With the yo-yo, and the means for rotation, in the initial position shown in FIG. 2, the user will hold the rotation bodies fixed while the string is wound about the sleeve 24 in a clockwise direction as with a standard yo-yo. This places a clockwise torque on the sleeve 24, causing it to rotate clockwise. Since the sun gear is mounted on the sleeve, it also rotates, which causes the planet gear to orbit clockwise within the body 14. This will continue until the planet gear abuts against the blocking pin, which prevents further clockwise motion of the planet gear. Since the planet gear is in meshing engagement with the ring gear on the body and the sun gear on the sleeve, blocking of the planet gear blocks the sun gear, and thus the sleeve, against clockwise rotation with respect to the body 14. The string may thus be wound upon the sleeve in the usual manner.

After the string has been wound the yo-yo 10 is thrown downwardly, as with a standard yo-yo, while the user retains the second end of the string. Due to the winding of the string, this produces a clockwise torque upon the sleeve 24. As during the winding, the blocking pin prevents relative clockwise rotation of the sleeve. The torque exerted upon the sleeve is therefore transferred to the rotation bodies such that they rotate at a relatively high rate as the yo-yo travels downwardly along the string. As with a standard yo-yo, the rotation bodies also may be given an initial rotational velocity by the user throwing the yo-yo with a well known flip of the wrist.

When the yo-yo has unwound the entire length of the string it will be at the bottom of its travel and be rotating clockwise as a fixed unit. This will cause the yo-yo to attempt to rewind the string upon the sleeve in a counterclockwise direction, which normally causes a standard yo-yo to return to the user. However, with the present yo-yo the counterclockwise torque caused by this attempted rewind will free the means for rotation.

Specifically, the rotation of the sleeve in the counterclockwise direction is not prevented by the blocking pin, such that the sleeve may rotate with respect to the rotation bodies, and in particular will cease rotation with respect to the ground while the rotation bodies continue to rotate in the clockwise direction. This is referred to in the present invention as free rotation. During this free rotation the planet gear will orbit about the sun gear for several revolutions of the rotation bodies, until the blocking pin 48 abuts against the opposite side of the planet gear and blocks further orbiting.

In a manner analogous to that discussed above, in this position the sleeve is prevented from rotating counterclockwise with respect to the rotation bodies, which is the relative rotation required for the rotation bodies to rotate clockwise while the sleeve remains still with respect to the ground. Therefore the free rotation ends and the sleeve rotates clockwise with the rotation bodies, allowing the string to be wound counterclockwise upon the sleeve to return the yo-yo to the user, as with a standard yo-yo. The user may then throw the yo-yo downwardly again to repeat the process described above.

As may be seen from the above description, the yo-yo of the present invention will sleep at the bottom of the throw with very little skill required by the user. This will allow even novice users to perform various tricks, and increase their pleasure with the device. It is an important feature of the present invention that the free rotation, and thus the sleeping, can not begin until the string has completely unwound. This ensures that the maximum amount of torque is applied to the yo-yo. Additionally, during this sleeping the sleeve does not rotate with respect to the string, such that wear upon the string is greatly reduced.

Where the string is applied as a loop it is possible to continue the sleeping after the free rotation has stopped. Such sleeping would of course be the conventional sleeping associated with yo-yos. While this produces wear in the string, the amount of wear is less than that of conventional yo-yos, due to the period of free rotation. Additionally, when it is desired to end the conventional sleeping this is easily done since the sleeve is rotating with the rotation bodies.

It should also be apparent from consideration of the above description that the number of revolutions of the rotation bodies with respect to the sleeve achieved at the bottom of the throw (free rotations) is not related to the rotational speed of the yo-yo, but is a matter of the geometry and structure of the gears within the chamber, and as such is predetermined. The number of free rotations may of course be a fraction of a revolution, several full revolutions, or any number, whole or fractional, as determined by the particular means for rotation.

Since the number of free rotations is predetermined by the geometry or structure, it is possible to alter this number by altering the geometry or structure. In the present embodiment, this would involve altering the gear ratios, preferably by replacing the sun and planet gear with a different sun and planet gear set.

To allow the user to readily change the gear combination, and thus the number of free rotations, the second rotation body may be fixed to the shaft 22 by a threaded connection 51 such that it may be removed from the shaft. The body 14 would also include an access panel 52 which may be removed to provide access to the interior of the chamber 31, and thus to the gears, or to allow only the exterior portion of the body to be removed. The access panel may be connected to the body 14 as by threads 54. Alternatively, the entire rotation body 14 may be replaced.

While the possible number of free rotations is predetermined by geometry and structure, the actual number of free rotations achieved may be readily selected by the user. This actual number, which is less than the possible number, may be selected by the use of secondary blocking pins 56. Pins 56 may be inserted into secondary holes in the body 14 to extend into the chamber 31 and act in a manner similar to, and in addition to the blocking pin 48. As is apparent from FIG. 2, use of such a secondary pin will reduce the number of free rotations possible with the yo-yo by reducing the distance which the planet gear may orbit. A plurality of holes 50 are preferably provided at angularly spaced positions such that a single secondary pin 56 may be used in any of a number of locations to further vary the possible number of selectable free rotations.

Figure 3:
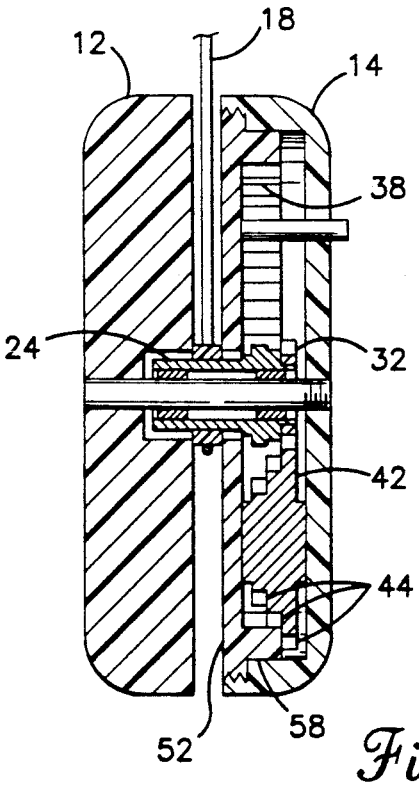
FIG. 3 is a front cross-sectional view of a second embodiment of a yo-yo according to the present invention.

A second embodiment of the present invention which allows an alternative means for predetermining the number of free rotations is shown in FIG. 3. In this embodiment all structure is similar to the first embodiment with the exception of the sleeve, the sun gear, the planet gear and the access panel.

In this embodiment the sleeve 24 includes a plurality of shoulders similar to the single shoulder of the first embodiment, such that sun gears of different sizes may selectively be mounted upon the appropriate shoulder. The shoulders are staggered in the longitudinal direction of the sleeve such that each sun gear will have a different longitudinal location. The planet gear 42 includes a plurality of sets of teeth 44 which are staggered similar to the shoulders and are adapted to mesh with the teeth of the appropriately mounted sun gear. This allows a single planet gear to be supplied, with only the sun gear being replaced to alter the free rotation geometry.

Additionally or alternatively, a plurality of access panels 52 may be provided, each of which includes an annular extension having a differently sized ring gear 38 formed on the interior thereof. The various access panels have ring gears adapted to mesh with the various sets of teeth formed on the planet gear.

With this arrangement the sun gear and/or the ring gear may be replaced with a different size to modify the number of free rotations achieved. Additionally or alternatively, a secondary blocking pin as in the first embodiment may also be employed to select the actual number of free rotations from the predetermined possible number.

Figure 4:
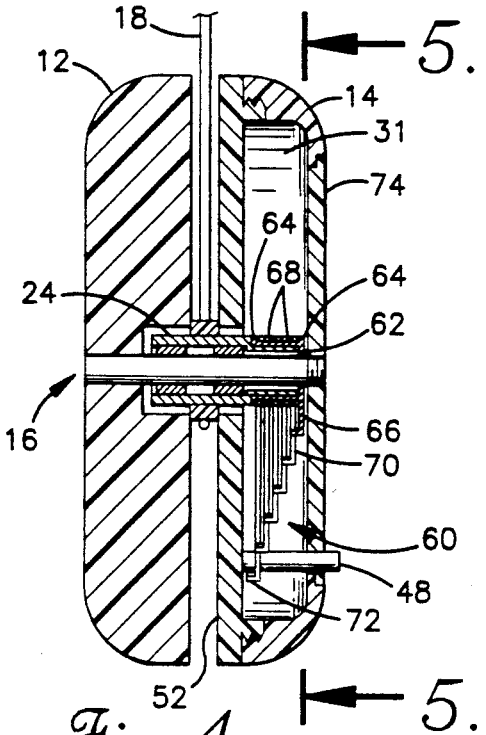
FIG. 4 is a front cross-sectional view of a third embodiment of a yo-yo according to the present invention.
Figure 5:
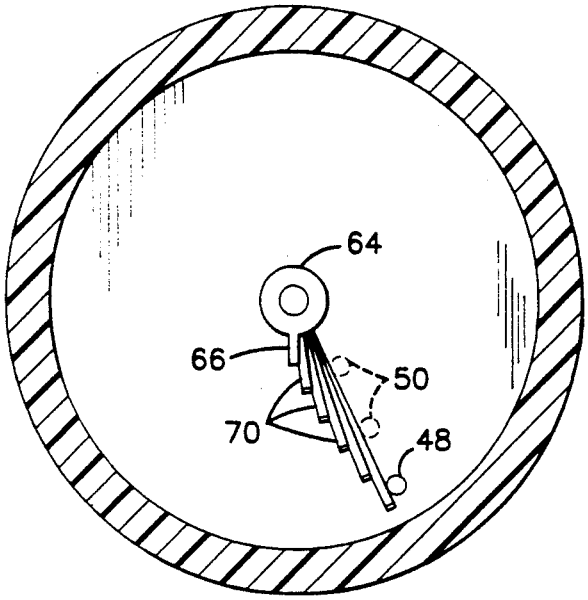
FIG. 5 is a cross-sectional view along line 5—5 of FIG. 4.

A third embodiment of the present invention is shown in FIGS. 4 and 5. This embodiment is similar to the first embodiment in that it includes rotation bodies 12 and 14, shaft 22, bearings 26, and a sleeve 24. However in this embodiment the means for rotation does not includes a gear system.

As is best shown in FIG. 4, the sleeve 24 includes a shoulder as in the previous embodiment, although it is preferred that the reduced diameter section extend a greater distance in the longitudinal direction. Flats may also be formed in this section as in the first embodiment. Mounted upon the reduced diameter end of the sleeve and abutting against the shoulder is a tine assembly generally designated by reference numeral 60.

The tine assembly 60 includes a body 62 having an interior cavity adapted to be received upon the reduced diameter section of the sleeve 24 in a non-rotational manner. The exterior of the body 62 is cylindrical, and includes an annular collar 64 at each end thereof. Extending outwardly from one of the collars 64, substantially perpendicular to the longitudinal axis of the sleeve, is a main tine 66. The collar 64 having the main tine may be formed integral with this main tine. Assembly 60 also includes a plurality of rings 68 mounted on the body 62 between the collars 64, with each of the rings being freely rotatable about the body.

Each of the rings 68 includes a secondary tine 70 extending outwardly therefrom substantially perpendicular to the longitudinal axis of the sleeve.

As may be seen from the figures, the tines 66 and 70 are of staggered lengths, and each includes a blocking nib 72 at the free end. The blocking nibs extend substantially perpendicular to the tines and are of a sufficient length such that each nib will engage an adjacent tine, but no other tines. The means for rotation also includes a blocking pin 48 within a hole 50 in the body 14 such that the pin will extend into the chamber 31 as in the first embodiment.

In operation the user will grasp the rotation bodies and wind the string upon the sleeve 24 in a counterclockwise direction (as seen in FIG. 5), causing the sleeve to rotate counterclockwise. Since the body 62, and thus the main tine 66, are fixed against rotation with respect to the sleeve, they are also subject to a counterclockwise rotation. This will rotate the main tine until its blocking nib contacts the adjacent secondary tine 70, which will then rotate along with the sleeve and the main tine until its blocking nib contacts the next adjacent secondary tine. This next adjacent secondary tine will then rotate along with the sleeve, main tine, and the first secondary tine. This process will continue until the blocking nib of each tine, with the exception of the tine furthest from the main tine, is abutting against an adjacent tine. Continued counterclockwise rotation will result in the tine furthest from the main tine, which is the longest tine, abutting against the blocking pin 48.

At this point the counterclockwise rotation of the sleeve with respect to the rotation bodies is blocked by the abutment of the various tines against each other and abutment of the longest tine against the blocking pin. The string may therefore be wound about the sleeve in a counterclockwise direction similar to a standard yo-yo. After the string has been sufficiently wound, the yo-yo is thrown downwardly while the user retains the free end of the string, as is well known. Similar to the first embodiment, this creates a counterclockwise torque on the sleeve, which is resisted by the tines and blocking pin. The entire yo-yo 10 therefore rotates as a fixed unit counterclockwise down the string.

When the string has fully unwound the rotation of the bodies and the sleeve continues and attempts to wind the string back upon the sleeve in a clockwise direction. This creates a clockwise torque on the sleeve, against which the sleeve is not blocked. As such, the sleeve, with the body 62 and tines 66 and 70, remain still with respect to the ground while the rotation bodies and shaft rotate counterclockwise in free rotation. As the body 14 completes the first free rotation the blocking pin 48 will abut against the opposite side of the tine furthest from the main tine. This tine will then be rotated along with the body 14 for a second revolution, and at the end of this will abut against the blocking nib of the adjacent tine, causing this tine to rotate with the body 14.

This sequence will continue for each of the secondary tines. At the end of the rotation which includes the secondary tine adjacent to the main tine, this secondary tine will abut against the blocking nib of the main tine. As with the previous tines, this will cause the main tine to rotate With the body 14. However, the main tine is fixed to the sleeve 24, and therefore the sleeve is fixed against relative clockwise rotation with respect to the rotation bodies. At this, the end of the free rotation, the sleeve will rotate, allowing the string to wind upon the sleeve, bringing the yo-yo upward to the user.

As may be readily seen from the above description, the third embodiment also unwinds completely as a fixed unit, engages in free rotation for a number of revolutions, and then again is configured as a fixed unit and travels upwardly to the user. This embodiment therefore shares the advantages of the first embodiment, set forth above.

It should also be apparent that the number of free rotations is equal to the number of times 66 and 70 which are employed. The number of free rotations is therefore predetermined by the geometry and structure. As such, the yo-yo 10 may be supplied with various tine assemblies 60, each having a different number of tines, which may be removably fixed upon the reduced diameter end portion of the sleeve 24.

Alternatively or additionally, the number of free rotations may be selectable. For this the rotation body 14 is provided with a plurality of holes 50 such that the blocking pin 48 may be placed within any one of these holes. In contrast to the first and second embodiments, the plurality of holes in this third embodiment may extend radially of the axis of rotation, as it is this radial distance which controls the number of free rotations. Specifically, if the blocking pin 48 shown in FIG. 5 were placed within a hole 50 radially closer to the access to rotation, after the first free rotation the pin 48 would abut against the opposite side of one of the secondary times 70 which does not correspond to that which has the longest radial length. As the blocking nib of this abutting tine would be in an engagement with the associated secondary tines 70, a plurality of the tines 70 would rotate along with the body 14 during the second rotation.

As in the previous description of the operation of this embodiment, the continued rotation of body 14 would result in successive ones of the tines 70, and finally the main tine 66, being placed in abutting relationship until the main tine, and thus the sleeve 24 rotate with the body 14. As such, it may be seen that the number of free rotations is reduced by the number of secondary tines 70 which travel during the second free rotation, minus one.

The embodiment shown in FIG. 4 also includes another variation. Specifically, the outer face of the body 14 includes an insert 74. This insert 74 is preferably permanently fixed to the body 14, as the shaft 22 is fixed to the insert 74 rather than directly to the body 14. It is therefore necessary for the insert 74 to transmit the rotation of the body 14 to the shaft 16, and vice versa, making a permanent connection preferable. While the insert 74 may be of the same or different color than the remainder of the body 14, it is possible to form the insert as a transparent member such that the action of the tines may be viewed by the user to increase the enjoyment of the yo-yo.

Figure 6:
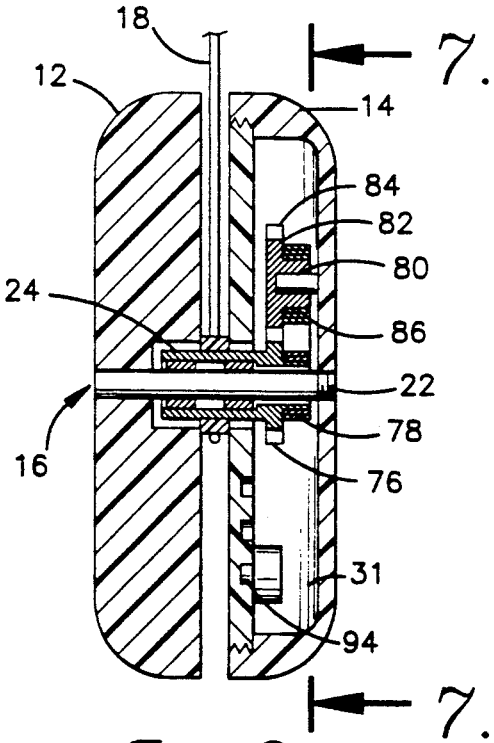
FIG. 6 is a front cross-sectional view of a fourth embodiment of a yo-yo according to the present invention.
Figure 7:
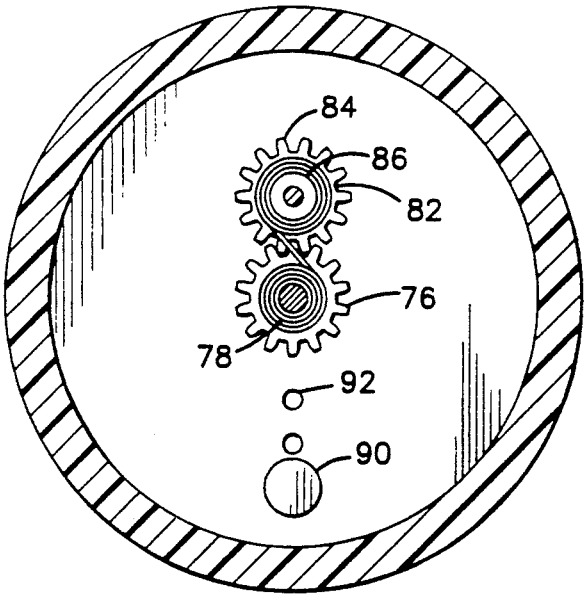
FIG. 7 is a cross-sectional view along line 7—7 of FIG. 6.

A fourth embodiment of the present invention is shown in FIGS. 6 and 7. This embodiment is similar to the first through third embodiments, in that it includes rotation bodies 12 and 14, shaft 22, bearings 26, and sleeve 24. However, the means for rotation takes a different form in this embodiment.

As is best shown in FIG. 6, the portion of the sleeve 24 which is extends into the cavity 31 includes exterior gear teeth 76 and a reel portion 78. As in the first through third embodiments, the gear teeth and reel portion may be formed as a separate element which is releasably fixed on the sleeve 24.

The body 14 also includes an axle 80 mounted within the cavity 31 at a position spaced from the shaft 22. This axle 80 rotatably mounts a take up reel 82. The take up reel 82 includes a plurality of exterior gear teeth 84 which are in meshing engagement with the gear teeth 76. The reel 82 also includes a reel portion 86 which is substantially aligned with the reel portion 84 in the longitudinal direction of the shaft 22. As is best shown in FIG. 7, a length of tape 88 is fixed to the reel portions 78 and 86 with a sufficient amount of slack such that the tape 88 may be wound upon the respective reel portions.

In operation, the user will wind the string in a direction, for example, clockwise (as seen in FIG. 7), which will thus exert a clockwise torque upon the sleeve 24. This torque will cause the sleeve to rotate which will, in turn, cause the gear teeth and reel portions to rotate. During this rotation the tap 88 will be transferred such that it is unwound from one reel portion and wound upon the other reel portion, in a manner similar to a tape cassette. When the tape is fully unwound from reel portion 86 and wound upon the reel portion 78 it will extend taut between the reel portions. At this point the continued clockwise rotation of the sleeve and take up reel will be blocked due to the presence of the tape 88. This will cause the sleeve 24 to be also blocked against rotation such that the user ma wind the string 18 about the spacer 30 in the usual manner.

Once the string has been sufficiently wound the user will throw the yo-yo in a downward direction while retaining the free end of the string 18. This will result in a clockwise torque being placed upon the sleeve 24. As the sleeve 24 is blocked against clockwise rotation relative to the bodies 12 and 14, this will result in such bodies rotating clockwise with the sleeve. When the string has been fully unwound the bodies 12 and 14 will still be rotating. such that the string will have a tendency to rewind upon the sleeve 24 in a counterclockwise direction. This will place the sleeve 24 under a counterclockwise torque. While the sleeve 24 was blocked against rotation relative to the body 14 in a clockwise direction, the presence of the tape 88 does not block such rotation in a counterclockwise direction.

Specifically the counterclockwise rotation of the sleeve with respect to the body 14 (by remaining still during clockwise rotation of the bodies) will result in a clockwise rotation of the take up reel 82 with respect to the body 14, due to the engagement of the respective gear teeth 76 and 84. As such the tape 88 will be unwound from the reel portion 78 and wound upon reel portion 86. This will continue for several relative rotations of the sleeve with respect to the body 14, such that a period of free rotation is achieved. When the full length of the tape 88 has been unwound from the reel portion 78 continued relative rotation between the reel portions will be blocked, as may be readily envisioned. Since the take up reel 82 is mounted upon the axle 80 (which is fixed to the body 14) blocking the relative rotation between the reel portions will result in the sleeve 24 being blocked against rotation relative to the body 14. As such, the free rotation ends and the sleeve 24 will rotate in the clockwise direction with the body 14 such that the string may be rewound upon the sleeve to cause the yo-yo to travel upwards toward the user.

This fourth embodiment therefore also exhibits the advantage of the other embodiments, such as being automatically placed in, and taken out of, a sleeping condition, and reducing wear on the string. Additionally, it may be seen that the number of free rotations is again predetermined by geometry and structure.

To allow the predetermined number of free rotations to be varied, it is preferred that the gear teeth 76 and reel portion 78 be formed as a removable unit, as discussed above, and that the take up reel 82 be removable from the axle 80. Such an arrangement will allow different sized components to be used, with the reel portions having a different diameter or the tape 88 having a different length.

In this embodiment the weight of the reel portion 78 and axle 80 may have a tendency to unbalance the yo-yo 10. As such, a counter weight 90 may be mounted to the body 14, preferably within the chamber 31, at a proper location opposite the take up reel with respect to the access of rotation. Where this yo-yo is designed to allow the reels to be replaced, the weight of the take up reel may vary such that the standard placement of the counter weight 90 is not proper. In such a situation the body 14 may include a plurality of mounting holes 92. The counter weight 90 would then include a mating prong 94 which will interference fit within the mounting holes 92 such that counter weight 90 may be spaced at various radial distances from the shaft 22 to provide the proper counter balance.

In operation, it may be found that the thickness of tape 88 wrapped about the reel portions may modify the effective diameters of the reel portions, such that only a few relative revolutions of the reel portions are possible before one of the reel portions will tend to wind up more tape than the other of the reel portion will unwind. This will result in the reel portions being fixed with respect to each other. It is thus desirable to form the tape as thin as possible to reduce this effect. Alternatively or additionally, the tape 88 may be formed of a resilient or elastic material to reduce the effect. Where the tape is a resilient material the number of free revolutions may still be closely approximated by mathematical means, with the actual amounts being empirically determined.

Figure 8:
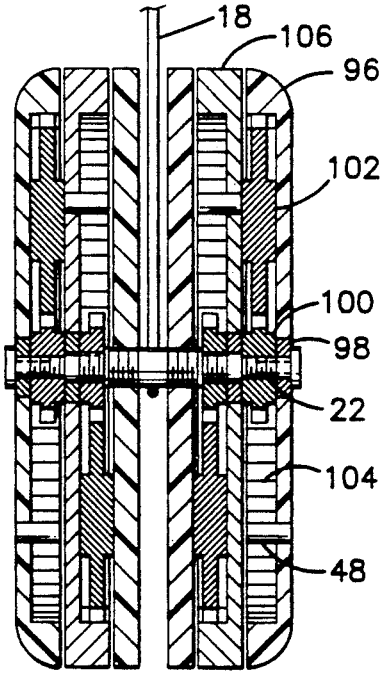
FIG. 8 is a front cross-sectional view of a fifth embodiment of a yo-yo according to the present invention.

A fifth embodiment of the present invention is shown in FIG. 8. This embodiment is simplified somewhat from the previous embodiments in that a shaft 22 is employed but the coaxial sleeve 24 and spacer 30 are dispensed with, such that the shaft means comprises only the shaft 22. Specifically, this embodiment employs a step shaft 22 which has one end of the string 18 connected thereto. The means for rotation in this embodiment are similar to that used in the first and second embodiment with one major difference. In the present embodiment the sun gear is fixed to the shaft 22, while the rotation bodies rotate with respect to the shaft 22. Specifically, the rotation bodies may be formed with bearings or a coating of low friction material at the rotational connection to the shaft. The rotation bodies are blocked, however, from movement along the longitudinal direction of the shaft.

Additionally, the present embodiment includes the variation that each of the rotation bodies 12 and 14 are comprised of a plurality of members, more than one of which may contain a means for rotation. For example, as shown in FIG. 8 the rotation body 14 is formed of an outer member 96 mounted upon the shaft 22 by bearings 98. A sun gear 100 is fixed to the shaft 22, and a planet gear 102 is operatively mounted between the sun gear 100 and a ring gear 104 formed on the interior of the outer body 96. As in the previous embodiments a blocking pin 48 extends into the outer member 96 to block movement of the planet gear 102.

Spaced inwardly of the outer member 96 is an intermediate member 106. The intermediate member is formed in a manner similar to the outer member, and includes a separate means for rotation having a sun gear, planet gear, and ring gear arrangement. Finally, the second rotation body 14 is completed by an interior member 108 which is fixed to the shaft 22. The interior member 108 ensures that the string 18 does not become tangled within the means for rotation. The first rotation body 12 may include similar members arranged as a mirror image.

The operation of the means for rotation within the intermediate and outer bodies should be clear from a reference to the first and second embodiments. The gears and blocking pin operate in a similar manner to block relative rotation of the shaft in a first direction during unwinding, allow relative rotation in the opposite direction during a predetermined number of free rotations, and again block rotation to allow recovery of the yo-yo. The advantages of the previous embodiments are therefore present in this embodiment also.

The provision of plural members in each rotation body may be employed such that the shaft 2 is subject to free rotation with respect to all of the intermediate and outer members at the same time. It should be apparent that free rotation will begin for all members at the same time. However, by appropriate gearing it is possible to have the various members cease free rotation at different times for unusual effects.

For example, the gearing of the intermediate members may be arranged such their free rotation ends slightly after that of the outer members. If the outer members are formed of a lightweight material such as plastic, and other portions of the yo-yo, such as the intermediate members, are formed of heavy material such as metal, cessation of free rotation in the lighter members will not impart enough rotational momentum to cause the string to fully rewind. This partial rewind may be quite small but cause a user-discernible tugging on the string and serve as an indication that the heavy member, which may cause full rewinding, is about to end free rotation. This would allow the user to end the current trick being performed and prepare for return of the yo-yo.

Alternatively, the first partial (or full) rewind may be underway when the other member ceases free rotation, causing a noticeable increase in the speed of yo-yo return. Such a slow-fast return may be found amusing and add a flourish to the trick performed. The members of different bodies could also cease free rotation at different times causing tilting of the entire yo-yo, although such an arrangement would probably best be reserved for more experienced users.

While not specifically shown, it should be apparent that the number of members employed for the bodies may be greater than that shown in FIG. 8, and that the two bodies need not be comprised of the same number of members. Additionally, the means for rotation in such an embodiment may take other forms, such as those shown in FIGS. 3–7, and different members may have different means for rotation.

While the present description has been mad with reference to specific embodiments, the invention is not limited to these embodiments. For example, the means for rotation could take other forms, such as a length of string located in the cavity and having respective ends fixed to the sleeve (or shaft) and the rotation body. The string would thus be wound about the sleeve for the initial blocking of rotation, would unwind and rewind during the free rotation, and the free rotation would end when the string was rewound about the sleeve. While such an embodiment may prove undesirable due to tangling of the string, it would be inexpensive to produce and causes little friction. From this example it should be seen that various means for rotation are available which have the advantages of those shown in the figures.

From the foregoing it will be see that this invention is one well adapted to attain all ends and objects herein above set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A yo-yo, comprising:

first and second rotation bodies each having an axis of rotation;

shaft means having a longitudinal axis substantially coincident with said axes of rotation, said shaft means being connected to said rotation bodies with said rotation bodies being in spaced relation;

a length of at least substantially flexible line, said line having a first end connected to a portion of said shaft means; and means allowing said shaft means to be fixed against rotation relative to said rotation bodies about said longitudinal axis in a first direction, yet permitting free rotation of said portion of said shaft means relative to said rotation bodies about said longitudinal axis in a second direction opposite to said first direction for a predetermined number of rotations, after which said shaft means is fixed against rotation relative to said rotation bodies about said longitudinal axis in said second direction.

2. A yo-yo as in claim 1, wherein said first end of said line is rigidly fixed to said shaft means.

3. A yo-yo as in claim 1, wherein said first end of said line is connected to said shaft means to allow rotation of said shaft means with respect to said end of said line.

4. A yo-yo as in claim 1, wherein said means fixing and permitting rotation includes means for selecting said number of free rotations, said number of free rotations being selectable up to the number of predetermined free rotations.

5. A yo-yo as in claim wherein said shaft means comprises a shaft fixed to said rotation bodies and a sleeve rotatably and substantially coaxially mounted on said shaft, and said first end of said line being connected to said sleeve.

6. A yo-yo as in claim 5, wherein said means for fixing and permitting rotation comprises:

a sun gear mounted on a longitudinal end of said sleeve and disposed within a chamber within said second rotation body, said sun gear being substantially coaxial with said sleeve and having a plurality of gear teeth;

a ring gear fixed to said second rotation body within said chamber, said ring gear being substantially coaxial with said sleeve and having a plurality of gear teeth;

a planet gear disposed within said chamber and having a plurality of gear teeth constituting a set of teeth said gear teeth of said planet gear being in meshing engagement with said gear teeth of said sun gear and said ring gear, whereby rotation of said sun gear with respect to said ring gear will cause rotation of said planet gear with respect to said second rotation body; and a blocking pin mounted on said second rotation body and extending into said chamber such that said pin may block, by abutment, rotation of said planet gear with respect to said second rotation body.

7. A yo-yo as in claim 6, further comprising at least one hole in said second rotation body opening in to said chamber, said hole being angularly spaced from said blocking pin with respect to said longitudinal axis, and further comprising a secondary blocking pin adapted to be inserted into said hole and extend into said chamber such that said secondary pin may also block, by abutment, rotation of said planet gear with respect to said second rotation body, whereby said number of free rotations is selectable up to the number of predetermined free rotations.

8. A yo-yo as in claim 6, wherein said second rotation body includes an access panel allowing access to said chamber, and wherein said sun gear is removably mounted on said sleeve, and further comprising at least one additional sun gear and planet gear set adapted to replace said sun gear and said planet gear mounted in said rotation body, each said additional sun gear and planet gear set having different respective diameters, whereby exchange of said sun and planet gears will alter the rotation caused in said planet gear as a result of rotation of said sun gear with respect to said ring gear.

9. A yo-yo as in claim 6, wherein said planet gear includes a plurality of said sets of gear teeth, each of said sets being arranged bout a different diameter, and said second rotation body includes an access panel removably mounted thereon and allowing access to said chamber, said ring gear being formed on said access panel.

10. A yo-yo as in claim 9, further comprising at least one additional access panel adapted to be alternatively mounted to said rotation body, each said additional access panel having a set of gear teeth thereon arranged about different diameters, whereby replacement of said access panel with one of said additional access panels will allow one of said sets of gear teeth on said planet gear engage therewith to thereby alter the rotation caused in said planet gear as a result of said rotation of said sun gear with respect to said ring gear.

11. A yo-yo as in claim 10, further comprising at least one additional planet gear adapted to replace said planet gear mounted in said rotation body, each said additional planet gear having different respective diameters, whereby exchange of said planet gears will alter the rotation caused in said planet gear as a result of rotation of said sun gear with respect to said ring gear.

12. A yo-yo as in claim 5, wherein said means for fixing and permitting rotation comprises:

a tine body mounted on an end of said sleeve and disposed within a chamber within said second rotation body;

a main tine fixed to said tine body and extending radially outwardly from said longitudinal axis, said main tine having a blocking nib located at the free end thereof;

a plurality of secondary tine rotatably mounted on said tine body, each extending outwardly from said longitudinal axis by staggered distances and having a blocking nib located at the free end thereof, whereby said blocking nibs of said main and secondary tine may abut against an adjacent one of said tines; and a blocking pin extending into said chamber such that said pin may block, by abutment, rotation of one of said tine with respect to said second body.

13. A yo-yo as in claim 12, wherein said blocking pin is mounted in a hole in said second body, said hole opening into said chamber.

14. A yo-yo as in claim 13, further comprising a plurality of said holes, each of said holes being spaced from said longitudinal axis by a different radial difference, whereby said blocking pin may be inserted into any one of said holes to thereby select the number of free rotations up to the number of predetermined free rotations.

15. A yo-yo as in claim 5, wherein said means for fixing and permitting rotation comprises:

a first reel portion and a first plurality of gear teeth mounted on an end of said sleeve and disposed within a chamber within said second rotation body;

a take up reel rotatably mounted on said second body within said chamber at a point offset from said longitudinal axis, said take up reel including a reel portion and a plurality of gear teeth, said respective gear teeth being in operative meshing engagement; and a length of flexible line having one end fixed to said reel portion and a second end fixed to said reel portion of said take up reel, said length being sufficient to allow said line to be wound from one of said reel portions to the other.

16. A yo-yo as in claim 15, wherein said first reel portion and teeth are removably mounted on said sleeve, and said take up reel is removably mounted on said second body, and further comprising at least one additional first reel portion and teeth and take up reel set, each said additional set having a different gear ratio.

17. A yo-yo as in claim 1, wherein at least one of said rotation bodies comprises a plurality of members each having an axis of rotation substantially coincident with said axes of rotation, and wherein said means for fixing and permitting rotation comprises separate means for fixing and permitting rotation for each of said members.

18. A yo-yo as in claim 17, wherein said predetermined number of rotations for one of said members is different than said predetermined number of rotations for another of said members.

19. A yo-yo, comprising:

first and second rotation bodies each having an axis of rotation;

shaft means having a longitudinal axis substantially coincident with said axes of rotation, said shaft means being connected to said rotation bodies with said rotation bodies being in spaced relation;

a length of at least substantially flexible line, said line having a first end connected to a portion of said shaft means; and means allowing said portion of said shaft means to rotate with respect to said rotation bodies in a direction of rotation for a user-selectable number of free rotations, after which said shaft means is fixed against rotation in said direction.

20. A yo-yo, comprising:

first and second rotation bodies each having an axis of rotation;

shaft means having a longitudinal axis substantially coincident with said axes of rotation, said shaft means being connected to said rotation bodies with said rotation bodies being in spaced relation;

a length of at least substantially flexible line, said line having a first end connected to said shaft means; and means allowing said shaft means to be fixed against rotation relative to said rotation bodies about said longitudinal axis in a first direction during unwinding of said line from said shaft means, yet permitting free rotation of said shaft means relative to said rotation bodies about said longitudinal axis in a second direction opposite to said first direction or a predetermine number of rotations upon complete unwinding of said line, a distance from a second end of said line to said longitudinal axis being constant, except for elongation in said line, during said predetermined number of rotations, after which said shaft means is fixed against rotation relative to said rotation bodies about said longitudinal axis in said second direction to thereby allow said line to be rewound about said shaft means.

* * * * *